US006666140B2

(12) United States Patent
Roller

(10) Patent No.: US 6,666,140 B2
(45) Date of Patent: Dec. 23, 2003

(54) IGNITION DEVICE FOR PYROTECHNIC MICROCHARGES

(75) Inventor: Denis Roller, La Ferte Alais (FR)

(73) Assignee: SNPE, Paris (FR)

( * ) Notice: Subject to any disclaimer, the term of this patent is extended or adjusted under 35 U.S.C. 154(b) by 0 days.

(21) Appl. No.: 10/175,067

(22) Filed: Jun. 20, 2002

(65) Prior Publication Data

US 2003/0010243 A1 Jan. 16, 2003

(30) Foreign Application Priority Data

Jul. 13, 2001 (FR) ..... 01 09376

(51) Int. Cl.[7] ..... F42C 19/12

(52) U.S. Cl. ..... 102/202.8; 102/202.5; 102/322

(58) Field of Search ..... 102/202.5, 322, 102/202.8, 200

(56) References Cited

U.S. PATENT DOCUMENTS

| | | | | |
|---|---|---|---|---|
| 3,815,507 A | | 6/1974 | Irish, Jr. et al. | |
| 3,983,624 A | * | 10/1976 | Gross | 29/854 |
| 4,213,392 A | | 7/1980 | Usel | |
| 5,215,419 A | | 6/1993 | Steinhilber | |
| 5,495,806 A | * | 3/1996 | Willey | 102/202.14 |
| 5,942,717 A | * | 8/1999 | Pathe et al. | 102/202.2 |
| 6,080,248 A | | 6/2000 | Finck et al. | |
| 6,205,927 B1 | * | 3/2001 | Findley | 102/472 |
| 6,247,485 B1 | * | 6/2001 | Rossi et al. | 137/68.13 |
| 6,352,506 B1 | * | 3/2002 | Eppstein et al. | 600/309 |
| 6,521,489 B2 | * | 2/2003 | Duthaler et al. | 438/149 |

FOREIGN PATENT DOCUMENTS

| | | | | |
|---|---|---|---|---|
| BE | 840 674 A | | 10/1976 | |
| DE | 19805539 A1 | * | 8/1999 | C06C/9/00 |
| DE | 199 56 635 A1 | | 2/2001 | |
| EP | 8265 A1 | * | 2/1980 | C06B/21/00 |
| EP | 0 076 210 A1 | | 4/1983 | |
| FR | 1 227 960 A | | 8/1960 | |

* cited by examiner

*Primary Examiner*—Charles T. Jordan
*Assistant Examiner*—T. Nguyen
(74) *Attorney, Agent, or Firm*—Oliff & Berridge, PLC

(57) ABSTRACT

A device for igniting a solid pyrotechnic charge, including a conducting track, wherein the track consists of a conducting fluid deposited at least partially on the pyrotechnic charge, the pyrotechnic charge is deposited on a solid support and covers an empty cavity of the support, and the cavity forms a empty space between the pyrotechnic charge and the support.

10 Claims, 1 Drawing Sheet

IGNITION DEVICE FOR PYROTECHNIC MICROCHARGES

The technical field of the invention is that of devices for igniting pyrotechnic charges, and more specifically those involving a heating device. The ignition devices according to the invention are particularly suitable for small pyrotechnic charges such as, for example, those which are involved in microvalves or micropumps and which are described in patent FR 2 774 684. These small pyrotechnic charges can also be found in other fields of application such as miniature propulsion units for positioning satellites, fuel cells or miniature heat generators.

Devices for igniting pyrotechnic charges comprising a heating device already exist and have been the subject of numerous patents. The one most commonly used is the device involving a conventional resistive heating element, such as a hot wire supplied with an electric current. However, currently, there are no ignition devices made from depositing a conductive fluid directly on the pyrotechnic charge. The term conducting fluid refers to materials such as a paint, varnish or conducting ink.

One of the problems encountered when igniting small pyrotechnic charges is that linked to the conductive heat losses. This is because the charges and the hot wire are generally in contact with a solid support and part of the heat released by the wire is dissipated in the support, making it difficult or even impossible to ignite the said charges. It is then required to supply excess energy, with a consequent significant heating of the support, which is not systematically sought.

The ignition device according to the invention remains efficient at low energy, without leading to particular damage to the parts or walls forming the immediate environment of the charge.

The subject of the present invention relates to a device for igniting a solid pyrotechnic charge, comprising a conducting track, characterized in that the said track consists of a conducting fluid deposited at least partially on the pyrotechnic charge. In this way, the ignition device is intimately associated with the pyrotechnic charge and remains completely independent of the immediate environment of the said charge.

According to a first preferred embodiment of the invention, the conducting fluid is deposited by screen printing.

According to a second preferred embodiment of the invention, the conducting fluid is a conducting ink and the conducting track is produced by jet-spraying the said ink. These two techniques are broadly proven in the microelectronics field and especially in the preparation of conducting microcircuits. Advantageously, the pyrotechnic charge is deposited on a solid support and the conducting track is only in contact with the said charge. Thus, all the energy dissipated by the Joule effect is transmitted in full to the pyrotechnic charge without heat exchange with the support. Preferably, the support comprises a cavity and the pyrotechnic charge, which is in the form of a film, covers the said cavity. Preferably, the pyrotechnic charge is based on nitrocellulose. The cavity forms a free space between the pyrotechnic charge and the support, further reducing a little more any conductive heat exchange between these two elements. This configuration is particularly suitable for very small objects no greater than a few millimeters in size, since, at these orders of magnitude, the pyrotechnic charge can be deposited on the cavity in the form of a drop which will spread due to the film-forming ability of the said charge.

The invention also relates to a method of producing a device for igniting a pyrotechnic charge, characterized in that the conducting fluid is deposited directly on the pyrotechnic charge. According to a first preferred embodiment of the method according to the invention, the deposition is carried out by screen printing. According to a second preferred embodiment of the method according to the invention, the conducting fluid is a conducting ink and the deposition is carried out by jet-spraying the said ink.

The ignition devices according to the invention have the advantage of being able to be mass-produced because of their great implementational simplicity. Furthermore, they achieve considerable flexibility of use depending on the characteristics of the pyrotechnic charge, whether this is its composition or its geometry. This is because, depending on the texture of the charge, the conducting fluid can be relatively thick and, depending on the type of ignition sought, the conducting track may coat a particular shape and be relatively spread out. Finally, the pyrotechnic charge and the conducting track form an integral and autonomous assembly, which can be integrated as such in a pre-existing microcircuit.

The detailed description of a preferred embodiment of an ignition device according to the invention is given below with reference to FIGS. 1 and 2.

Figure 1:
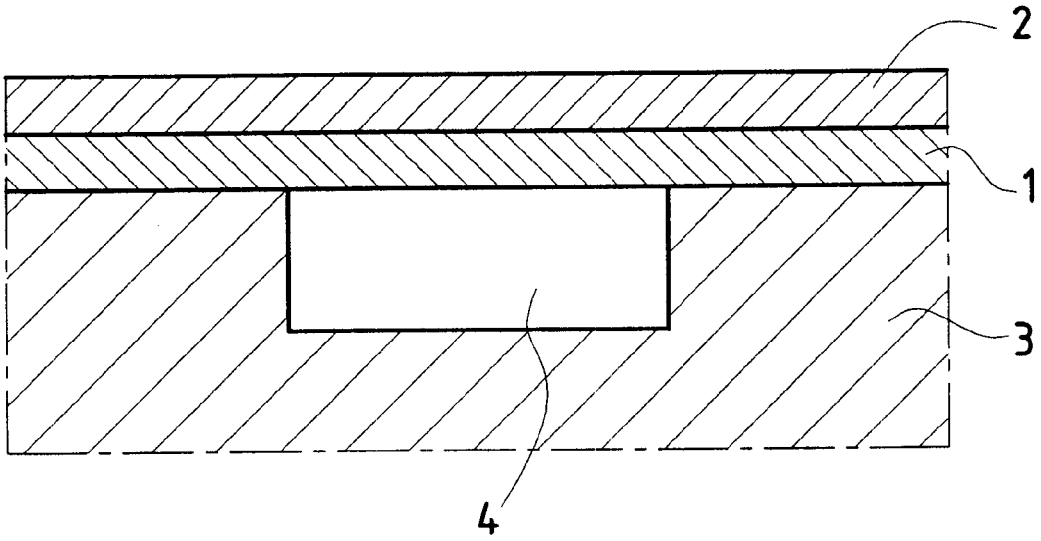
FIG. 1 is a sectional view of an ignition device according to the invention for a support having a cavity.
Figure 2:
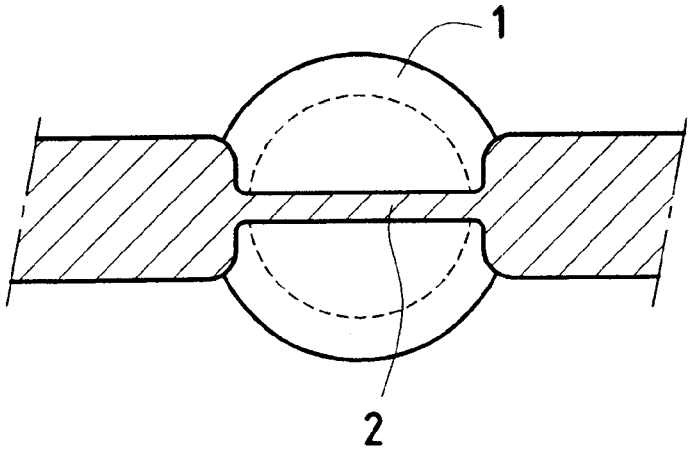
FIG. 2 is a top view of the ignition device of FIG. 1.

With reference to FIGS. 1 and 2, the pyrotechnic charge 1, which contains nitrocellulose, is deposited on a cylindrical cavity 4 with a diameter of 1.5 mm, hollowed out in a polycarbonate support 3. The charge 1 is in the form of a discoid film, whose thickness of 5 $\mu$m could be between 1 and 100 $\mu$m. The conducting track 2 results from the deposition of a conducting ink by inkjet directly on the charge 1 and, ideally, the said charge 1, which completely covers the cavity 4, is inserted between the support 3 and the said track 2. The conducting track 2 has the shape of a fine strip of a few $\mu$m in thickness, crossing the charge 1 along one of its diameters. Such a configuration makes it possible to minimize the conductive heat losses through the support 3.

The operating mode of this type of ignition remains conventional. An electric current is delivered into the conducting track 2 which immediately increases in temperature. The heat thus released by the Joule effect is directly transmitted to the charge 1 which catches fire and generates gases which can actuate micropyromechanisms.

What is claimed is:

1. A device for igniting a solid pyrotechnic charge, comprising a conducting track, wherein the track consists of a conducting fluid deposited at least partially on the pyrotechnic charge, the pyrotechnic charge is deposited on a solid support and covers an empty cavity of the support, and the cavity forms an empty space between the pyrotechnic charge and the support.

2. The ignition device according to claim 1, wherein the conducting fluid is deposited by screen printing.

3. The ignition device according to claim 1, wherein the conducting fluid is a conducting ink and the conducting track is produced by jet-spraying the ink.

4. The ignition device according to claim 1, wherein the conducting track is only in contact with the pyrotechnic charge.

5. The ignition device according to claim 1, wherein the pyrotechnic charge is in the form of a film.

6. The ignition device according to claim 1, wherein the pyrotechnic charge is based on nitrocellulose.

7. The ignition device according to claim 1, wherein the conducting fluid is deposited directly on the pyrotechnic charge.

8. The ignition device according to claim 7, wherein the deposition is carried out by screen printing.

9. The ignition device according to claim 7, wherein the conducting fluid is a conducting ink and the deposition is carried out by jet-spraying the said ink.

10. The ignition device according to claim 5, wherein the pyrotechnic charge is based on nitrocellulose.

* * * * *